United States Patent [19]

Henneman et al.

[11] 4,186,735

[45] Feb. 5, 1980

[54] BREATHING APPARATUS

[76] Inventors: John W. Henneman, 4416 39th Ave., Rock Island, Ill. 61201; Michael G. Flood, 6119 Hickory Crest, Spring, Tex. 77373

[21] Appl. No.: 789,646

[22] Filed: Apr. 21, 1977

[51] Int. Cl.[2] ..... A62B 7/00

[52] U.S. Cl. ..... 128/201.25; 128/204.25; 128/204.26

[58] Field of Search ..... 128/142 R, 142.2, 142.3, 128/142.4, 142.5, 142.6, 142.7, 145.8, 147, 202, 203, 191 R; 2/424 R, 9 R, 10 R, 410 R, 2.5 R, 7 R

[56] References Cited

U.S. PATENT DOCUMENTS

| | | | |
|---|---|---|---|
| 807,666 | 12/1905 | Drager | 128/142.2 |
| 2,325,049 | 7/1943 | Frye et al. | 128/191 R |
| 3,043,302 | 7/1962 | Spears et al. | 128/203 |
| 3,526,239 | 9/1970 | Oroza | 128/142.2 X |
| 3,911,914 | 10/1975 | Johansson | 128/142.7 |
| 3,976,063 | 8/1976 | Henneman et al. | 128/203 X |

FOREIGN PATENT DOCUMENTS

| | | | |
|---|---|---|---|
| 1163153 | 2/1964 | Fed. Rep. of Germany | 128/142 R |
| 2626176 | 12/1976 | Fed. Rep. of Germany | 128/142.2 |
| 18871 | of 1912 | United Kingdom | 128/142.7 |

*Primary Examiner*—Henry J. Recla

[57] ABSTRACT

A portable breathing apparatus for use in a noxious atmosphere includes a helmet that is closed except for a bottom opening that is provided with a neck seal to permit the helmet to be slipped over the head of the wearer while sealing the open bottom of the helmet to provide an airtight enclosure about the wearer's head. A backpack includes a high pressure oxygen cylinder, that is connected to a regulator valve through a pressure reducer; and a carbon dioxide scrubber, that receives expiration gas from the helmet through an exhaust breathing line which connects to a flexible reservoir which collects the majority of expired gases and which is provided with a relief valve to protect the bag and limit expiration resistance. The outlet of the reservoir is connected to the inlet of the scrubber and the outlet of the scrubber being connected to a second inlet in the regulator valve by a line that includes a heat exchanger associated with the oxygen cylinder so that the oxygen cylinder removes heat from the recirculating gas from the carbon dioxide scrubber. The regulator valve has an outlet chamber connected to the helmet interior through an inlet breathing line and the regulator valve includes an on-off-type valve that delivers oxygen from the oxygen supply to the chamber through an injection nozzle only when inhalation by the wearer causes a pressure drop in the chamber that acts on a diaphragm to open the valve. The gas from the scrubber enters the chamber in a reduced pressure zone adjacent the nozzle outlet, the reduced pressure helping to pull scrubbed gases from the carbon dioxide scrubber.

12 Claims, 4 Drawing Figures

BREATHING APPARATUS

BACKGROUND OF THE INVENTION

This invention relates to a breathing apparatus and more particularly to a self-contained portable breathing apparatus for temporary use by a wearer in a noxious atmosphere, such as is worn by fire fighters when exposed to smoke or noxious gases.

Such portable breathing apparatuses are generally either of the open loop or the closed loop type. In the open loop system, compressed air is delivered to the wearer and the expired gases are vented to the atmosphere. Such systems are relatively simple and have the advantage of providing cool breathing gas and a minimum of breathing resistance. However, since the gas is not reused, a system of reasonable weight has a relatively short duration of breathing supply, while being relatively heavy. In a closed loop system, the exhaled gases are directed through a device that generates oxygen or at least removes the carbon dioxide from the gas, which is recycled to the wearer, and although some high pressure gas is normally supplied, the gas tank is relatively small and lightweight, so that the breathing system provides a relatively long duration of air supply while being relatively lightweight. However, such systems have the disadvantage of a relatively high breathing resistance, a moisture buildup in the system, and a heat buildup in the recycled gas, so that the wearer is breathing relatively warm gas.

Typically, prior systems have featured a face mask that is uncomfortable and cumbersome for the wearer, and while some of the more modern systems have utilized a helmet, it has still been necessary to provide a face seal with its attendant disadvantages.

SUMMARY OF THE INVENTION

According to the present invention, there is provided an improved portable breathing system of the closed loop type. An important feature of the invention resides in the efficient usage of the gas supply, providing a system that is relatively light in weight while providing a relatively long duration breathing supply.

Another important feature of the invention resides in the provision of means for reducing the breathing resistance through the carbon dioxide scrubbing apparatus in the system. More specifically, the system includes a pressure demand or on-off regulator valve, that only delivers oxygen to the user upon demand caused by inhalation by the user. Also, the oxygen supply is delivered to the user through an injector nozzle in the regulator valve that creates a low pressure zone at the nozzle outlet, which is disposed adjacent to the gas inlet from the scrubbing device, so that the low pressure zone helps to suck air contained in the reservoir bag from the previous expiration through the scrubbing device, thereby reducing breathing resistance.

Another feature of the invention resides in the provision of a heat exchanger between the oxygen supply tank, which is cooled as a result of the discharge of high pressure gas therefrom, and the warmed, recycled exhalation gas that is delivered from the scrubbing device, to cool the breathing gas.

Another feature of the invention resides in the provision of a helmet that gives the wearer complete head protection, and further in the provision of a neck seal for the helmet so that the entire interior of the helmet forms an airtight enclosure about the head of the wearer, the breathing and exhalation lines being connected to the helmet interior so that the conventional face mask can be eliminated.

Still another feature of the invention resides in the simple and rugged construction of the helmet and a backpack which includes the scrubbing device, the oxygen supply, and the regulator valve.

DESCRIPTION OF THE PREFERRED EMBODIMENT

Figure 4:
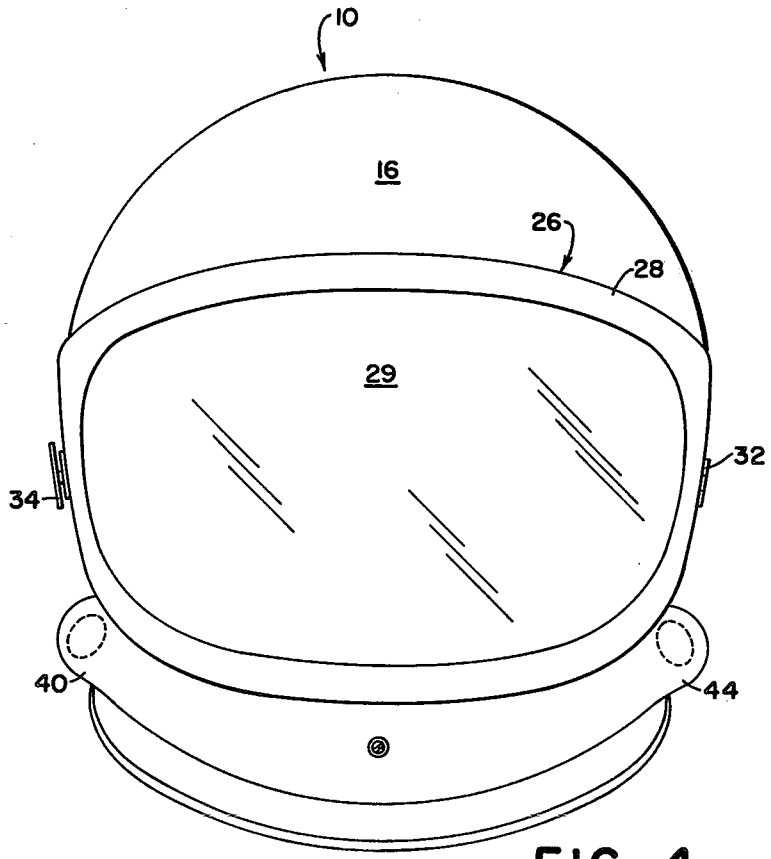
FIG. 4 is a front view of the helmet.
Figure 3:
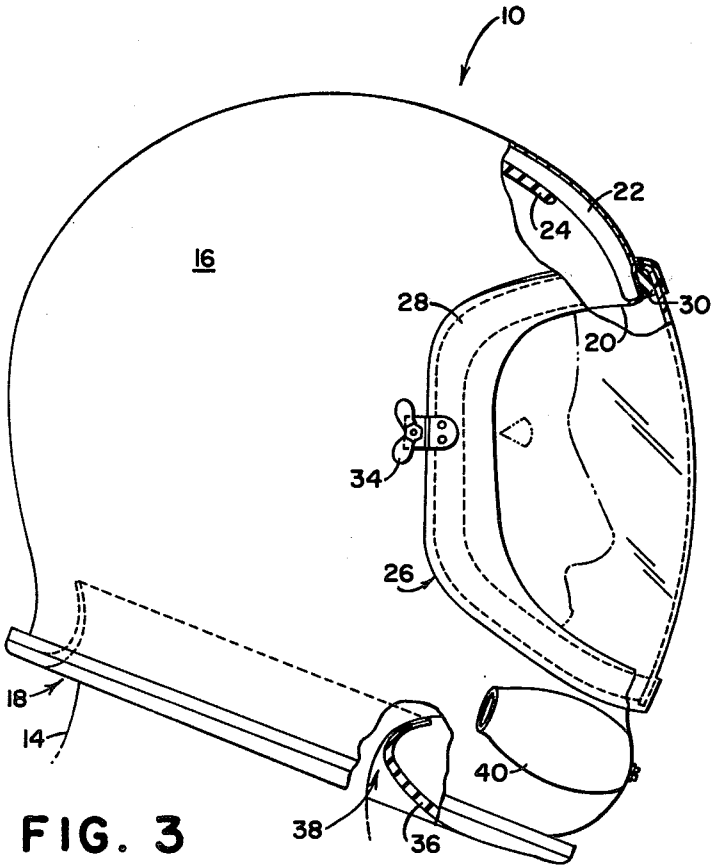
FIG. 3 is a side elevation view of the helmets installed on the wearer, with portions of the helmet broken away to show the interior construction.

The invention is embodied in a portable breathing apparatus that includes a helmet, indicated in its entirety by the numeral 10, and a backpack, indicated in its entirety by the numeral 12, the helmet being adapted for mounting over the head of the user or wearer 14 while the backpack is supported on the back of the wearer by means of shoulder straps 15. The helmet 10 includes a rigid hood or shell 16 that is molded from strong and rigid plastic, such as used by pilots or astronauts, and has a bottom opening 18 adapted to receive the head of the wearer and a relatively large face opening 20 that substantially spans the width of the front of the helmet and extends approximately from the wearer's mouth to his hair line to afford a relatively wide range of vision. The helmet includes a liner 22 of insulating, shock-absorbing material and a strap-type head support 24, all of the above being of more or less known construction. The face opening 20 is closable by a door 26 that includes a somewhat rectangular frame 28 which holds a transparent window 29. The door frame 28 is slightly larger than the outline of the face opening 20 and has a seal 30 on its inner side around its entire periphery, the seal 30 seating against the exterior of the helmet shell 16 adjacent the face opening 20 when the door is in a closed condition. The door is mounted on a hinge 32 at one side of the face opening and is swingable thereon between a closed condition, as shown in FIGS. 3 and 4, and an opened position wherein it extends outwardly from the wearer. A latch 34 is provided on the opposite side of the door from the hinge to tightly clamp the door against the helmet shell when the door is closed.

An annular, flexible neck seal 36 has a central neck opening 38 and is mounted around the bottom opening 18. The neck opening 38 is smaller than the neck size of any potential user, and flexes and stretches sufficiently to pass over the wearer's head when the helmet is put on, the edge of the neck seal opening 38 tightly seating against the neck of the wearer and the outer portion of the neck seal seating against the bottom of the helmet to seal the helmet interior and consequently the wearer's respiratory system from the ambient atmosphere when the door 26 is in its closed condition. Neck seals for helmets such as described above are known and have been used by astronauts in the space program.

The helmet includes an inlet port 40 on the right side of the helmet below the door 26, and the inlet port 40 is connected to an inlet breathing line 41 by means of a quick disconnect device 42 of conventional construction. An inlet check valve 43, also of conventional construction, is disposed in the inlet port 40 to permit movement of gas only into the helmet interior. An exhaust port 44 is disposed on the opposite side of the helmet from the inlet port 40 immediately below the door and is connected to an exhaust breathing line 46 by means of a quick disconnect device 48. The exhaust port is provided with a check valve 50 that permits movement of gas only from the helmet interior.

The backpack 12 includes a rigid housing 52 that is preferably made of rigid plastic or the like to protect the backpack contents. Mounted in the housing is a carbon dioxide scrubbing device indicated in its entirety by the numeral 54. Such scrubbing devices are well known and are provided with a pack of carbon dioxide-absorbing material, indicated by the numeral 56. Various carbon dioxide-absorbing materials are well known and readily available at relatively inexpensive prices. Alternately, a material could be provided that chemically converts carbon dioxide to oxygen to generate oxygen, such as potassium superoxide, although such materials are not as readily available and are more expensive. A breathing bag or exhaust gas reservoir 58 is disposed in the scrubbing device 54 between the carbon dioxide-absorbing material 56 and the exhaust breathing line 46 to supply exhaust gas to the scrubbing device when the breathing apparatus operates, the breathing bag being flexible and filling with gas as the wearer exhales in the well-known manner. A relief valve 60 is provided in the exhaust breathing line 46 at the inlet of the breathing bag 58 and vents gas to the atmosphere when the exhaust gas exceeds the capacity of the scrubbing device and results in a back pressure in the exhaust breathing line. The scrubbed gas is delivered to an outlet line 62 at the bottom of the scrubbing device 54.

An oxygen cylinder 64 is mounted in the housing 52 adjacent the scrubbing device and is inverted so that its outlet is adjacent the bottom of the housing. A pressure reducer 66 is mounted on the oxygen cylinder outlet, and is schematically illustrated since it is of well-known construction, the reducer significantly reducing the outlet pressure of the oxygen supply. An on-off valve is associated with the pressure reducer 66 and is controlled by a control knob 67 extending through the bottom of the housing 52. Also associated with the pressure reducer is a fill port 68 for recharging the oxygen cylinder and a pressure gauge 70 that is disposed on the exterior of the housing and is connected to the oxygen cylinder by a line 71, whereby the wearer by observing the gauge can determine the amount of oxygen in the oxygen supply cylinder. A pressure switch 72 having an associated battery is mounted in the line 71 so that the switch closes when the pressure in the gauge line falls below a predetermined value, the switch being connected by an electric lead 74 to a warning light 75 that is disposed in the helmet interior in a location visible to the wearer. The electric lead 74 is provided with a disconnect device 76 so that the helmet can be removed from the rest of the system by disconnecting the electric lead and the inlet and exhaust breathing lines. As is apparent, the warning light directs the attention of the user to the fact that his oxygen supply is running low when it goes on.

A bypass line 78 extends between the pressure reducer and the breathing line 41, and a bypass valve 80 controls the flow through the line 78, the valve being actuated by a knob on the exterior of the housing so that the wearer can selectively open the valve to permit oxygen flow directly from the regulator to the breathing line in the event that a malfunction obstructs the normal flow to the breathing line.

Figure 2:
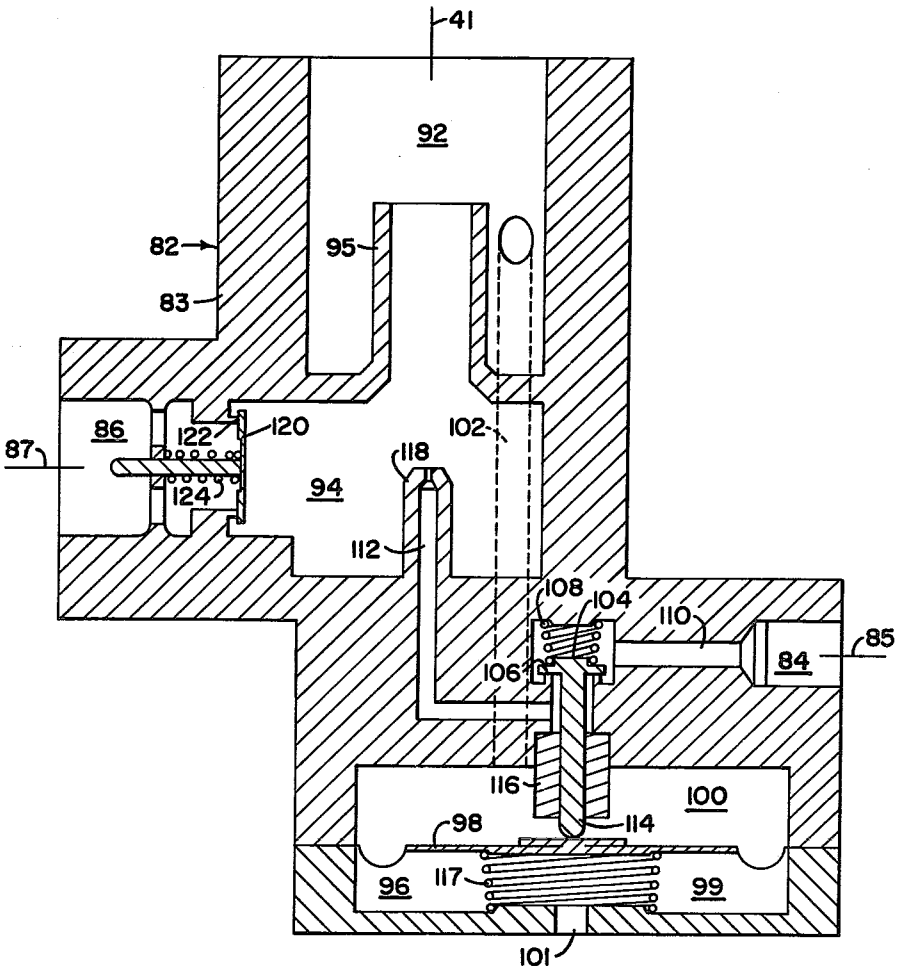
FIG. 2 is an enlarged, somewhat schematic section through the regulator valve.
Figure 1:
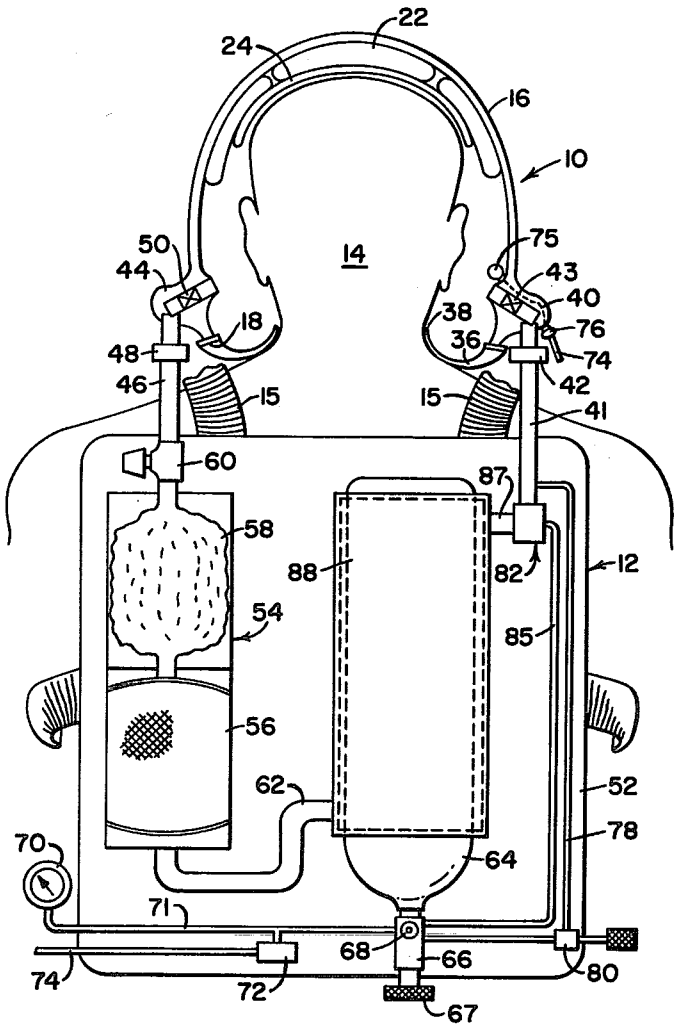
FIG. 1 is a somewhat schematic view of the breathing system in use by a wearer.

A regulator valve 82 is mounted in the housing adjacent the upper end of the oxygen cylinder 64 and is described and somewhat schematically shown in greater detail in FIG. 2. The regulator valve 82 includes a valve body 83 having an oxygen supply inlet 84 that is connected to the outlet of the pressure reducer 66 by an oxygen supply line 85. The regulator valve has a second inlet 86 that is connected to an inlet line 87 that is in turn connected to the outlet line 62 of the scrubbing device 54 through a heat exchanger 88. The heat exchanger in the illustrated embodiment is simply a jacket that encompasses substantially the entire length of the oxygen cylinder 64, the jacket being sealed at the top and the bottom and having a relatively small annular air passage 90 between the jacket and the cylinder, the outlet line 62 being connected to the bottom of the jacket while the line 87 to the regulator valve is connected to the top of the jacket so that air moving from the scrubbing device to the regulator valve 82 passes in intimate contact with the oxygen cylinder 64 for cooling thereby. Alternately, the outlet line could be wound tightly around the oxygen cylinder to transfer heat thereto before it is connected to the regulator valve. As is well known, the flow of high pressure gas from the cylinder causes a cooling of the cylinder.

The regulator valve also includes an outlet chamber 92 that is connected to the breathing line 41. Forming a part of the outlet chamber 92 is a low pressure chamber 94 that is disposed within the valve body and is connected to the outer portion of the chamber 92 by a tubular orifice 95.

At the opposite end of the body is a cavity 96 having a flexible diaphragm 98 that spans the cavity to divide the cavity into outer and inner chambers 99 and 100 respectively. The outer chamber 99 is connected to the atmosphere by means of a vent 101, while the inner or diaphragm chamber 100 is connected to the outlet chamber 92 by a sensing line 102. A poppet-type valve 104 is biased against its valve seat 106 by a relatively light spring 108 and is disposed between a passage 110 connected to the oxygen inlet 84 and a passage 112. A valve plunger 114 is connected to the valve 104 and extends through a bushing 116 into the inner chamber portion 100 and engages the inside of the diaphragm 98. The diaphragm is biased against the plunger 114 by a diaphragm spring 117, and when the pressure drops in the chamber 92 as a result of inhalation by the user, the sensing line 102 causes a corresponding drop in pressure in the chamber 100 which causes the diaphragm 98 to flex upwardly moving the valve 104 to an open condition, whereby oxygen flows through the passage 110, the valve 104 and into the passage 112. An injector nozzle 118 at the end of the passage 112 extends into the chamber 94, so that oxygen moving through the valve 104 is discharged into the chamber 94 through the injector nozzle. A relatively high velocity discharge of the gas from the nozzle 118 creates an area of low pressure in the chamber 94 adjacent to the nozzle by the well-known venturi effect.

A valve 120 seats against an annular valve seat 122 between the scrubbed gas inlet 86 and the chamber 94, and a relatively light spring 124 biases the valve 120 toward an open condition. When the pressure drops in the chamber 94 as a result of the inhalation of the gas and the venturi action of the gas flowing from the nozzle 118, the reduced pressure with the aid of the spring 124 causes the valve 120 to open so that the gas is pulled from the port 86 into the chamber 94, where the oxygen escaping from the nozzle 118 is mixed with the recirculated gas from the scrubbing device.

In operation, when it is desired to use the breathing apparatus, the backpack 12 is first strapped onto the back of the user and the helmet is then mounted on the head of the user with the door 26 in an open position. The quick disconnects 42 and 48 for the breathing lines are then connected and the disconnect 76 for the electric lead is also connected. With the door open, the operator can reach into the interior of the helmet and manipulate the neck seal 36 so that it properly seats against his neck to provide a comfortable and secure seal.

To initiate use, the operator merely has to turn on the on-off valve via the knob 67 and close the helmet door 26. Oxygen then flows through the line 85 to the regulator valve inlet 84. As soon as the user inhales, the pressure in the chamber 92 and consequently the chamber 100 lowers so that the diaphragm 98 opens the valve 104, whereupon oxygen flows through the valve and out through the nozzle 118 as previously described. The flow continues until the wearer stops inhaling to allow the pressure in the chamber 92 to build up to a point that the diaphragm returns to the position as shown in FIG. 2, wherein it permits the valve 104 to close, which shuts off the flow of oxygen through the nozzle 118. As the user exhales, the check valve 43 prevents the return of air into the breathing line 41 so that the exhaled gas passes through the line 46 into the breathing bag 58. From the breathing bag a constant flow of air moves through the carbon dioxide-absorbing material 56 and the scrubbed air is returned to the regulator valve through the line 62, the heat exchanger 88 and the line 87, the scrubbed air entering the valve inlet 86. As long as the user is exhaling, the valve 120 would normally remain closed due to a pressure drop across the scrubbing device, but on inhalation, the oxygen flow through the nozzle is started again to reduce the pressure in the chamber 94, which causes the valve 120 to open, pulling the scrubbed gas through the valve 120 where it is mixed with the oxygen in the chamber 94. As previously described, the heat exchanger 88 cools the recycled gas passing through the scrubbing device 54 to aid in the comfort of the user.

As is apparent, the oxygen flows only when the user is inhaling, and the on-off characteristic of the oxygen flow optimizes the use of the oxygen. The use of the venturi action through the nozzle 118 helps to pull air through the gas scrubbing device 54 to reduce the breathing effort. As is also apparent, the user is not encumbered by a face mask which would reduce his vision and encumber his operation, while the helmet 10 provides the necessary protection. When the user is free of the noxious atmosphere, he can breathe ambient air by simply opening the helmet door while shutting off the on-off valve via the valve knob 67.

If a carbon dioxide scrubber is utilized which produces oxygen as a by-product of absorbing the carbon dioxide, then compressed air rather than oxygen could be used in the cylinder 64 because the oxygen produced by the scrubber would more than equal the metabolic oxygen consumed by the body. For the purposes of the invention and the claims herein, the term "oxygen supply" is used generically to include both a supply of pure oxygen or compressed air, which contains other gases in addition to oxygen.

We claim:

1. A portable breathing apparatus for use by a wearer having a respiratory system and comprising: an inlet breathing line; an exhaust breathing line; means for connecting the inlet and exhaust breathing lines to the respiratory system of the wearer; an oxygen supply; an exhaust gas scrubbing means having an inlet connected to the exhaust breathing line, an outlet, and means for removing carbon dioxide from exhaust gas moving from the inlet to the outlet; and a regulator valve means including a housing having a first inlet, means connecting the first inlet to the oxygen supply, a second inlet, means connecting the second inlet to the scrubbing means outlet, an outlet chamber connected to the inlet breathing line, an injector nozzle opening into the outlet chamber, a first valve means operative to connect the first inlet to the injector nozzle when it is in an open condition, spring means operatively biasing said first valve means in a normally closed position, a diaphragm chamber, means connecting the diaphragm chamber to the outlet chamber to equalize the pressure in said chambers, a diaphragm at one end of the diaphragm chamber and shiftable in response to changes of pressure therein, means connecting the diaphragm to the first valve means to open the valve means when the pressure created by inhalation in the diaphragm chamber falls below a predetermined value to cause oxygen flow through the injector nozzle to the outlet chamber and means operative to connect the second inlet to the outlet chamber, so that gas from the gas scrubbing means is mixed with oxygen flowing through the nozzle, the means connecting the second inlet to the outlet chamber including a second valve means responsive to the pressure in the outlet chamber adjacent to the nozzle and operative to move between an open condition to connect the second inlet to the outlet chamber when the pressure in the chamber is reduced adjacent the nozzle as a result of gas flowing through the nozzle and a closed condition wherein it disconnects the second inlet from the outlet chamber.

2. The invention defined in claim 1 wherein the means connecting the breathing lines to the respiratory system of the wearer comprises a helmet having a bottom opening adapted to slip over the head of the wearer as the helmet is put on, a flexible neck seal in the bottom opening and including means having a neck opening adapted to expand to slip over the head of the wearer and contract to seat around the neck of the wearer when the helmet is worn, the neck seal sealing the helmet bottom opening to form a substantially airtight enclosure about the head of the wearer, the helmet including an inlet and an outlet respectively connected to the inlet and exhaust breathing lines.

3. The invention defined in claim 1 wherein the means connecting the second inlet to the scrubbing means outlet includes heat exchanger conduit means closely surrounding a substantial portion of the oxygen supply to transfer heat from the gas moving from the scrubbing means to the oxygen supply.

4. The invention defined in claim 1 wherein the exhaust breathing line includes an expansible exhaust gas reservoir adjacent the scrubbing means inlet for temporarily storing gas expired by the wearer in excess of the immediate capacity of the scrubbing means to treat said gas.

5. A portable breathing apparatus for use by a wearer having a respiratory system and comprising: an inlet breathing line; an exhaust breathing line; means for connecting the inlet and exhaust breathing lines to the respiratory system of the wearer; an oxygen supply; an exhaust gas scrubbing means having an inlet connected to the exhaust breathing line, an outlet, and means for removing carbon dioxide from gas moving from the inlet to the outlet; and regulator valve means including a housing having a first inlet connected to the oxygen supply, a second inlet connected to the scrubbing means outlet, an outlet chamber connected to the inlet breathing line, a nozzle communicating with said outlet chamber and connected in said first inlet, a first valve means operative to connect the first inlet to the outlet chamber via said nozzle when it is in an open condition, spring means operatively biasing said first valve in a normally closed position, diaphragm means shiftable in response to pressure in the outlet chamber, means connecting the diaphragm means to the first valve means to open the valve means when the pressure caused by inhalation in the outlet chamber falls below a predetermined value to cause oxygen flow from the oxygen supply to the outlet chamber, and second valve means responsive to the pressure in the outlet chamber to move between an open condition to connect the second inlet to the outlet chamber so that gas from the gas scrubbing means is mixed with oxygen flowing through the first valve means when the pressure in the outlet chamber falls below a predetermined value and a closed condition wherein it disconnects the second inlet from the outlet chamber.

6. The invention defined in claim 5 and including an injector nozzle discharging into the outlet chamber and connected to the first valve means so that oxygen flowing through the first valve means flows through the nozzle and creates a zone of reduced pressure in the outlet chamber adjacent to the nozzle.

7. A portable breathing apparatus for use by a wearer having a respiratory system and comprising: a pack adapted to be carried by the wearer and including an exhaust breathing line, an inlet breathing line, a pressurized oxygen supply container, a first connecting means operatively connecting the oxygen supply container to the inlet breathing line for delivering oxygen from the container to the breathing line at a reduced pressure, an exhaust gas scrubbing means having an outlet and operatively connected to and adapted to remove carbon dioxide from gas moving from the exhaust breathing line to the outlet, said gas having received heat from the respiratory system of the wearer, and second connecting means operatively connecting said outlet to the inlet breathing line and including heat exchanger means operatively closely surrounding a substantial portion of the oxygen supply container for transfering heat from the gas in said second connecting means to the container; and means for connecting the inlet and exhaust breathing lines to the respiratory system of the wearer.

8. The invention defined in claim 7 wherein the means for connecting the breathing lines to the respiratory system of the wearer comprises a helmet having a bottom opening adapted to slip over the head of the wearer as the helmet is put on, a flexible neck seal in the bottom opening and including means having a neck opening adapted to expand to slip over the head of the wearer and contract to seal around the neck of the wearer when the helmet is worn, the neck seal sealing the helmet bottom opening to form a substantially airtight enclosure about the head of the wearer, the helmet including an inlet and an outlet respectively connected to the inlet and exhaust breathing lines.

9. The invention defined in claim 7 wherein the first connecting means includes a regulator valve having a first valve means shiftable between open or closed conditions to respectively connect or disconnect the oxygen container from the inlet breathing line, and pressure responsive actuating means operatively connected to the first valve means and the inlet breathing line to shift the first valve means to its open condition when pressure in the inlet breathing line falls below a predetermined value and to its closed condition when said pressure exceeds said predetermined value.

10. The invention defined in claim 9 wherein the regulator valve includes an outlet chamber connected to the inlet breathing line and an injection nozzle between the first valve means and the outlet chamber, the second connecting means being connected to the outlet chamber adjacent to the nozzle so that a pressure reduction adjacent the nozzle as a result of gas moving therethrough tends to pull gas from the second connecting means.

11. A portable breathing apparatus for use by a wearer and comprising: a helmet having a bottom opening adapted to slip over the head of the wearer as it is put on, an annular, flexible neck seal means mounted in the bottom opening and having a neck opening adapted to expand to slip over the head of the wearer as the helmet is mounted and to contract to seat against the neck of the wearer when the helmet is worn, the neck seal sealing the helmet bottom opening to form a substantially airtight enclosure about the head of the wearer, and a door having a transparent portion opposite the eyes of the wearer and swingably mounted on the helmet for swinging between an open condition, wherein it permits exposure of the helmet interior to ambient atmosphere and provides manual access for adjustment of the neck seal, and a closed condition wherein it seals the helmet interior from the ambient atmosphere; a breathing line means connecting the air supply to the interior of the helmet; an exhaust means operatively connected to the helmet for permitting the exhaust of gas from the helmet interior; a portable pack adapted to be carried by the wearer and including an oxygen tank, an air scrubber means connected to and adapted to receive exhaust gas from the helmet exhaust means and remove carbon dioxide therefrom, and regulator valve means operatively connected to the air scrubber means, the oxygen tank and the breathing line for mixing oxygen from the oxygen tank with gas from the air scrubbing means and delivering the mixed gas to the breathing line; and heat exchanger conduit means connecting the air scrubber means to the regulator valve means and closely surrounding a substantial portion of the oxygen tank exterior in a heat exchanging relationship therewith to transfer heat from the gas in said conduit to the oxygen tank.

12. The invention defined in claim 11 wherein the helmet includes a warning light visible to the wearer, and including a source of electric power and a pressure switch means operatively associated with the air supply for connecting the warning light to the source of electric power when the pressure in the air supply falls below a certain value.

* * * * *